United States Patent [19]

Bako

[11] 3,975,933

[45] Aug. 24, 1976

[54] LATCHING DEVICE

[75] Inventor: Lazlo Bako, Woodcliff Lake, N.J.

[73] Assignee: Presto Lock Company, Division of Walter Kidde & Company, Inc., Elmwood Park, N.J.

[22] Filed: Jan. 23, 1975

[21] Appl. No.: 543,648

[52] U.S. Cl. ..... 70/70; 292/153

[51] Int. Cl.[2] ..... E05B 65/52

[58] Field of Search ..... 70/2–13, 70/69–76; 292/153

[56] References Cited

UNITED STATES PATENTS

| | | | |
|---|---|---|---|
| 1,585,799 | 5/1926 | Stone | 70/70 |
| 2,183,121 | 12/1939 | Levine | 70/70 X |
| 3,310,970 | 3/1967 | Humphries | 70/70 |
| 3,440,844 | 4/1969 | Constable | 70/70 |

*Primary Examiner*—Robert L. Wolfe

*Attorney, Agent, or Firm*—Shapiro and Shapiro

[57] ABSTRACT

In a latching device having a first push member to be depressed to releasably engage a hasp and a second push member cooperable with the first push member to be depressed to release the hasp, the cooperable parts of the push members comprise flat plate portions which are disposed in and movable in the same plane.

10 Claims, 9 Drawing Figures

LATCHING DEVICE

The invention relates to latching devices for hinged containers or receptacles having separable sections to be releasably secured together, and is more particulary directed to improvements in latching devices of the type disclosed in U.S. Pat. No. 3,310,970 to Humphries.

BACKGROUND OF THE INVENTION

Humphries U.S. Pat. No. 3,310,970 discloses a luggage lock having a longitudinally movable, lateral push bar for engaging a hasp and a transversely movable, vertical push bar cooperable with the lateral push bar for effecting release of the hasp. Each push bar is essentially a flat plate, except for a push-button tab formed at one end thereof, the lateral push bar overlying and being slidable on the vertical push bar. The push-button ends of the push bars are biased outwardly from the housing of the latching device by a pair of leaf springs. A step formed on the lateral push bar is engageable by an upstanding lug on the vertical push bar to provide two stable positions for the push bars. In the first position, which is reached by pushing the lateral push bar inwardly to engage the hasp, the lug on the vertical push bar engages a transverse edge of the step on the lateral push bar to hold the lateral push bar in engagement with the hasp. When the vertical push bar is pushed inwardly to reach the second position of the push bars, the lug is moved out of engagement with the transverse edge of the step, thereby permitting the lateral push bar to be moved outwardly out of engagement with the hasp by its associated spring. The lug then is engaged with a longitudinal edge of the step to maintain the vertical push bar in the inward position.

SUMMARY OF THE INVENTION

It is a principal object of the invention to provide an improved and simplified latching device of the type disclosed in the aforesaid Humphries, patent, and more particularly to provide an improved latching device of such type which may have a thinner construction than the Humphries latching device and which employs a single spring cooperable with both push members.

A latching device constructed in accordance with the present invention employs first and second manually operable push members both having flat plate portions disposed in the same plane. The first push member, which is formed to engage a hasp, is supported for movement between latching unlatching positions, while the second push member is supported for movement between hold and release positions, the flat plate portions of both push members being disposed in and movable in the same plane. The flat plate portions of the push members provide cooperable hook parts in that plane. When the second push member is in the hold position, the hook parts are in engagement for preventing movement of the first or hasp-engaging push member from the latching position, the hook parts being disengaged to enable movement of the hasp-engaging push member to unlatching position when the second or release push member is moved into the release position.

In the preferred embodiment, opposite arm portions of a single, coiled torsion spring urge both push members outwardly from the housing of the latching device toward their unlatching and hold positions, respectively. This spring moves the first push member into unlatching position when the second push member is moved by manual force into the release position and returns the second push member to the hold position when the manual force applied thereto is released.

The housing of the latching device includes a frame positioned beneath the push members and a cover which substantially overlies the push members and is connected to the frame. The frame has transverse ribs for supporting the push members for movement. The cover provides longitudinal guide walls cooperable with opposite edges of the first push member to guide that push member along a substantially linear path between the latching and unlatching positions. The cover also provides a projection which is received by an opening near one end of the second push member for providing pivotal movement of that push member between the hold and release positions.

BRIEF DESCRIPTION OF THE DRAWINGS

The invention will further be described with reference to the accompanying drawings, which illustrate preferred and exemplary embodiments, and wherein.

DETAILED DESCRIPTION OF THE PREFERRED EMBODIMENT

Figure 1:
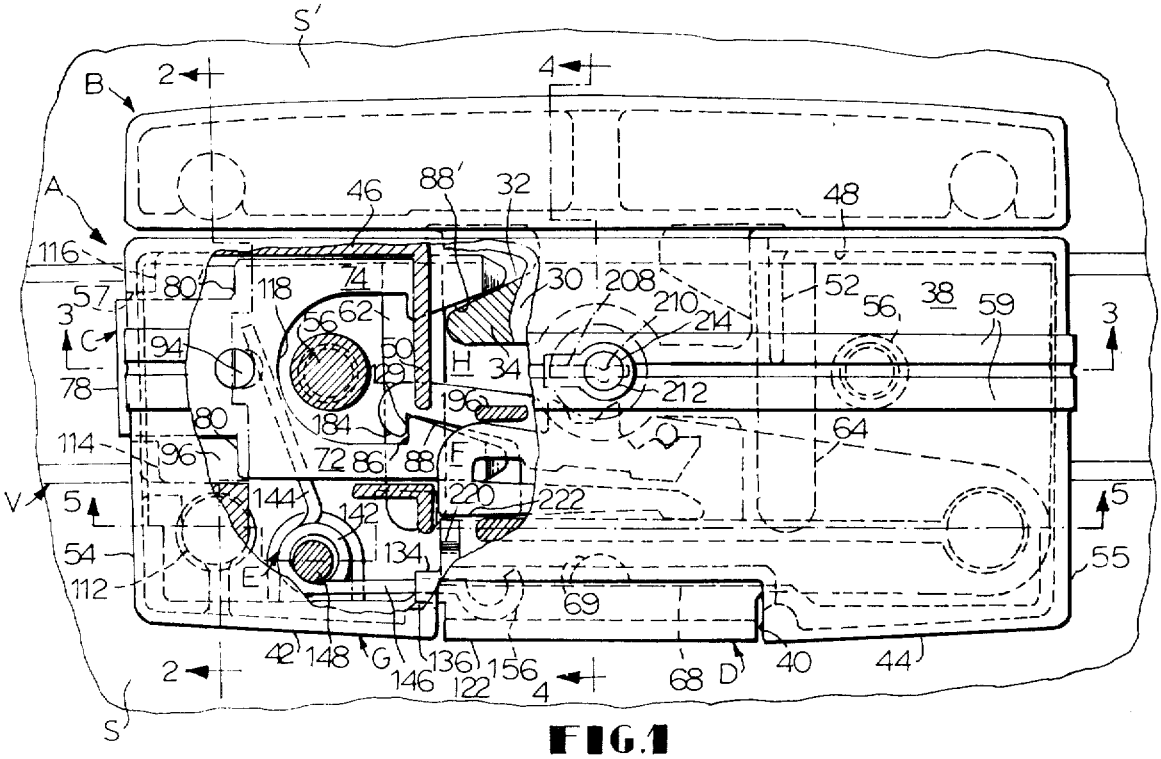
FIG. 1 is a top plan view of a latching device made in accordance with the invention connected to the wall of one luggage case section and engaging a cooperable hasp connected to the wall of the other luggage case section, the cover being broken away and in cross-section to show the relationship of parts for latching condition.

Referring to FIG. 1, a latching device A made in accordance with the invention and shown mounted on wall S of one luggage case section is cooperable with a hasp B mounted on wall S′ of the other luggage case section. It will be understood, however, that the latching device of the invention may be employed to releasably lock together the cooperable sections of other suitable hinged containers and cases.

The latching device employs manually operable latching and release push members C and C, respectively, a biasing spring E, and a bolt member F, these parts being contained in a housing proved by a cover G and a frame H. For convenience of manufacture and assembly, the hasp and cover are preferably formed by die-casting these parts, while the push members, bolt member and frame preferably comprise stamped parts.

Figure 3:
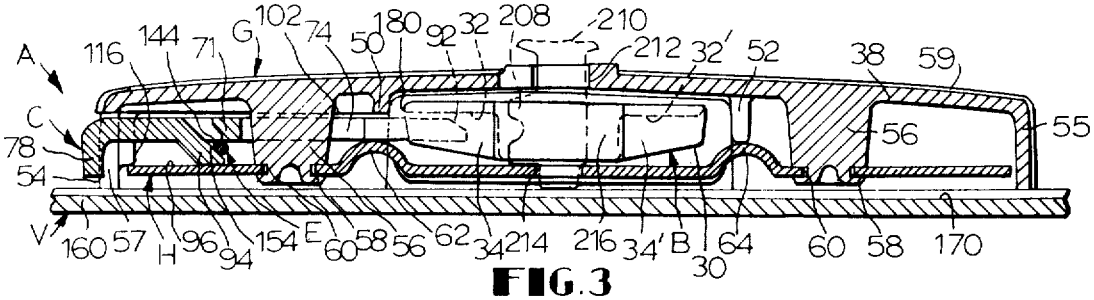
FIG. 3 is a longitudinal cross-sectional view taken approximately in the plane of line 3—3 of FIG. 1, this view showing the relationship of the latching device to the top flange of the associated valance member.
Figure 6:
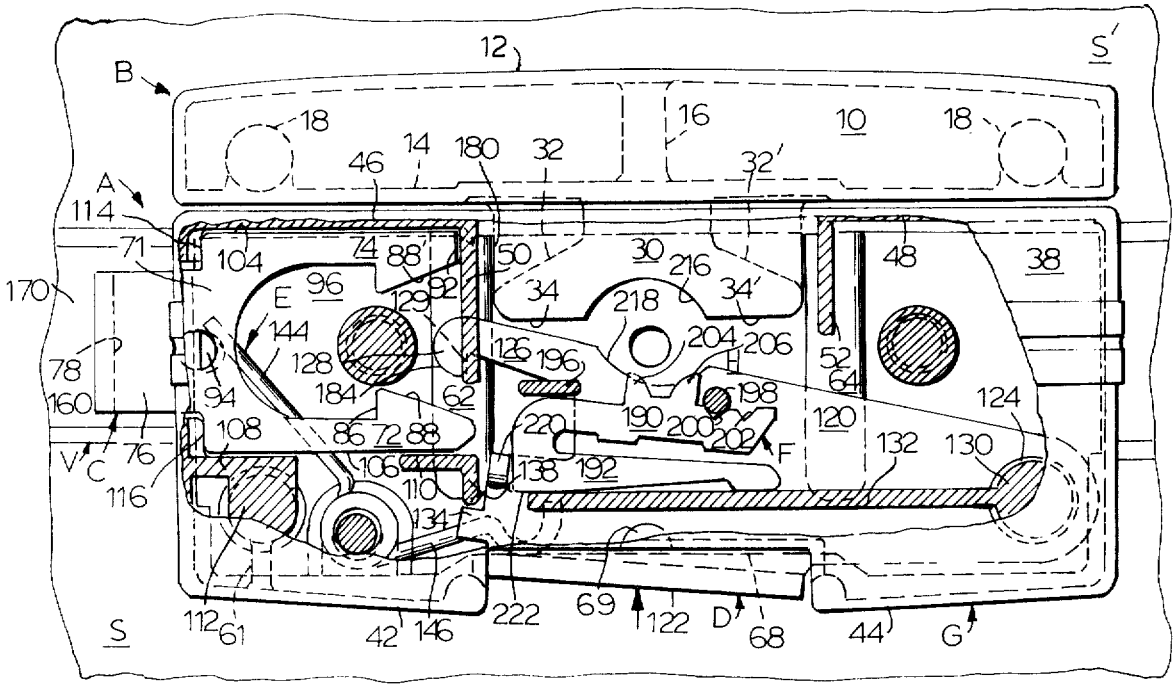
FIG. 6 is a top plan view similar to FIG. 1, but with the parts shown in unlatching condition.
Figure 4:
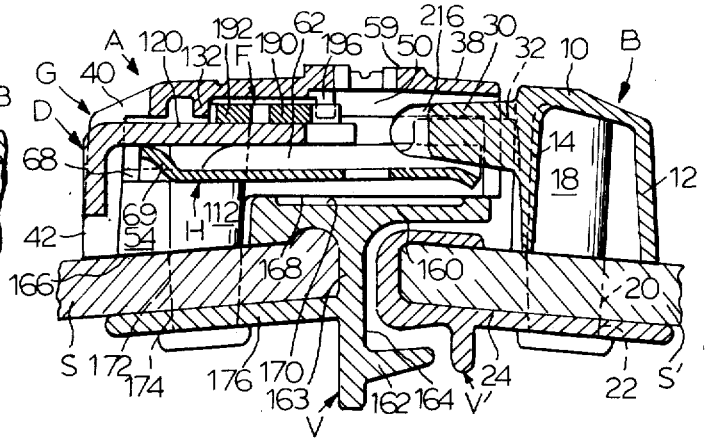
FIG. 4 is a transverse cross-sectional view taken approximately in the plane of line 4—4 of FIG. 1.

Referring to FIGS. 4 and 6, hasp B has a narrow, longitudinally extending, base portion 10 having longitudinal side walls 12 and 14 which are re-enforced by a transverse, central wall 16. The base portion may be hollow, as shown. The hasp may be mounted on luggage case wall S' by any suitable means. For example, and as illustrated, the base portion 10 of the hasp may be provided with a pair of longitudinally spaced connecting studs 18 which, as shown in FIG. 4, are extended through openings 20 in wall S' and through aligned openings 22 in bottom flange 24 of a valance member V' which is suitably mounted to the edge of the wall, the connecting studs then being headed over to secure the hasp to the wall. Extending outwardly from the central portion of side wall 14 near the top thereof is a projection 30 which is engageable by push member C of latching device A in a manner described hereinafter. This projection, which is generally rectangular in plan (see FIG. 6), has the bottom surface thereof recessed at 32 and 32' (FIGS. 3 and 6) to form oppositely extending hook portions 34 and 34', hook portion 34 being shown most clearly in FIG. 1.

The illustrated latching device is constructed to act as the left-hand latching device when a pair of latching devices constructed in accordance with the invention are mounted on a luggage case. As will be apparent hereinafter, push member C of the illustrated left-hand latching device is engageable with only hook portion 34 of hasp projection 30, the oppositely extending hook portion 34' being provided so that the hasp may also be employed with a right-hand latching device (not shown).

Figure 9:
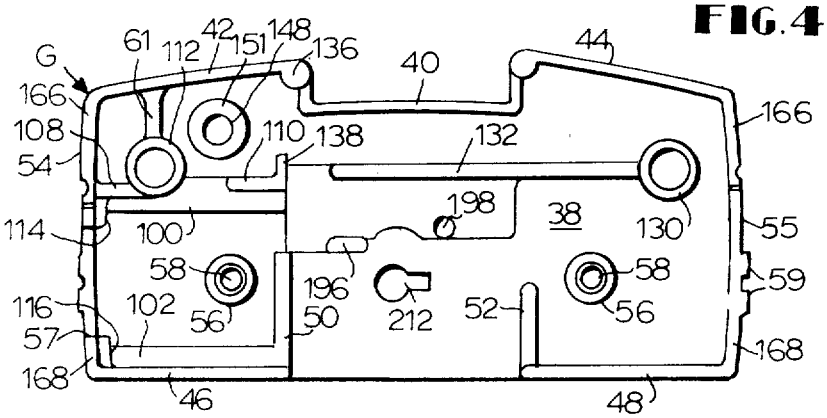
FIG. 9 is a bottom plan view of the cover component of the latching device.

Cover G and frame H form the housing of the latching device, which is mounted to wall S of the cooperable luggage case section in a manner later described and is constructed to receive projection 30 of the hasp when the luggage case is closed. In greater detail, and referring to FIG. 1, the cover has a longitudinally elongated, generally rectangular top wall 38. The longitudinal edge of the wall which is remote from hasp B has a central, rectangular notch 40 formed therein to enable manual engagement of push member D, described in detail later. Depending perpendicularly from opposite end portions of this longitudinal edge of the top wall on opposite sides of notch 40 are a pair of generally longitudinally extending side walls 42 and 44 (FIG. 9). In similar manner, side walls 46 and 48 depend perpendicularly from opposite end portions of the longitudinal edge of the top wall which is nearest the hasp, the longitudinal distance between the inner ends of these walls being sufficient to permit entry therebetween of projection 30 of hasp B, as shown in FIG. 6. The underside of top wall 38 provides a pair of longitudinally spaced, transversely extending ribs or walls 50 and 52 which merge with the inner ends of side walls 46 and 48, respectively, for guiding projection 30 into the latching device, wall 50 having lesser height than wall 52 (FIG. 3) for reasons which will become apparent. The cover is further provided with transverse end walls 54 and 55 (FIGS. 1 and 5) which depend from opposite ends of top wall 38. End wall 54 has a rectangular opening 57 therein (FIG. 1) through which one end of push member C extends for manual engagement. The outer surface of the cover may have a pair of decorative ribs 59 extending longitudinally across top wall 38 (FIG. 1) and continuing down the end walls 54 and 55 (FIG. 3).

Push members C and D, spring E, and locking bolt F (described hereinafter) are secured in the cover by frame H. The frame, which is preferably formed of a thin (.026 inch, for example), generally rectangular steel plate, is connected to the cover by any suitable means. For example, as shown in FIGS. 1 and 3, top wall 38 of the cover may be provided with a longitudinally spaced pair of connecting studs 56, each having an end 58 which extends through an opening 60 in the frame and is headed over to secure the frame to the connecting studs. The height of the connecting studs and the dimensions of the frame are selected so that the frame is supported between the side walls and end walls of the cover, as shown in FIG. 3. The cover further provides a transversely extending inner wall 61 (FIGS. 2, 6 and 9) formed integrally with side wall 42, top wall 38, and with a stud 112, later described. This wall engages the top surface of the frame, thereby reinforcing the position of the frame relative to the cover.

Figure 5:
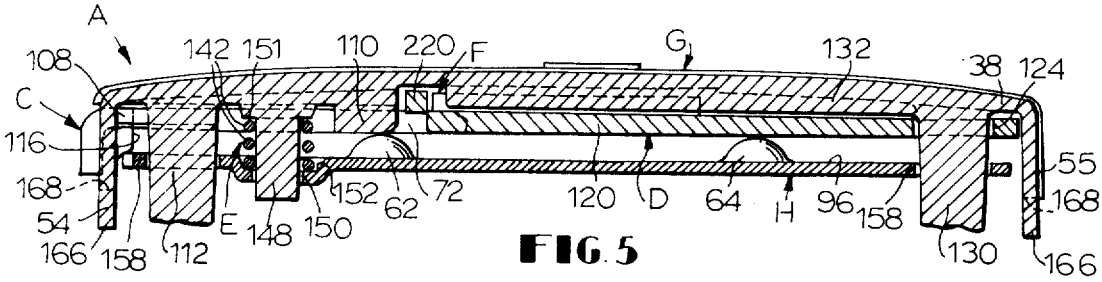
FIG. 5 is a longitudinal cross-sectional view taken approximately in the plane of line 5—5 of FIG. 1, but with the associated valance member and luggage case wall omitted.

Referring to FIGS. 3, 5 and 6, the frame has a pair of longitudinally spaced, upwardly projecting, transverse ribs 62 and 64 formed therein, these ribs extending the major part of the distance across the frame from the longitudinal edge of the frame which is nearest to hasp B. The longitudinal edge of the frame which is remote from the hasp has a notch 68 (FIG. 1) formed therein which is aligned with and has a greater longitudinal dimension than notch 40 in top wall 38 of the cover member. An upward projection 69 (FIG. 4) formed in the frame adjacent the central portion of the longitudinal edge of notch 68 (FIG. 1) is cooperable with ribs 62 and 64 for supporting push member D for sliding movement in the latching device.

Figure 8:
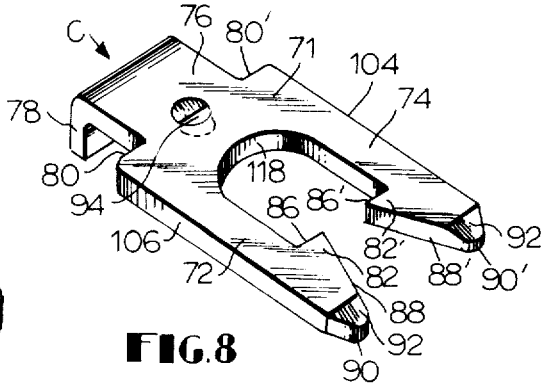
FIG. 8 is a perspective view of the latching push bar component of the latching device.

Referring to FIG. 8, push member C comprises a thin (.060 inch, for example) steel plate having a flat, generally U-shaped end portion 71 providing a pair of parallel, longitudinally extending legs 72 and 74. The opposite end portion 76, which is transversely narrower than end portion 71, extends oppositely from legs 72 and 74 in the plane of end portion 71 before bending perpendicularly downwardly therefrom to provide a manually engageable tab 78. End portion 71, being wider than end portion 76, provides a pair of transverse shoulders 80 and 80' on opposite sides of end portion 76. The outer end portions of legs 72 and 74 have inwardly directed extensions 82 and 82', respectively, to provide the push member with a pair of facing hook parts which lie in the plane of flat plate portion 71. These extensions provide shoulders 86 and 86', respectively, and also provide surfaces 88 and 88' which diverge from each other as they extend from the shoulders 86 and 86' to meet the rounded end surfaces 90 and 90', respectively, of the push member legs. As shown best in FIG. 8, the top surface of each leg adjacent the end thereof is inclined at 92 relative to the rest of end portion 71. The push member is struck at a point intermediate shoulders 80 and 80' thereof to provide a depending lug 94 (FIG. 3). The lug projects below end portion 71 of the push member a distance equal to the height of rib 62 of the frame.

Figure 2:
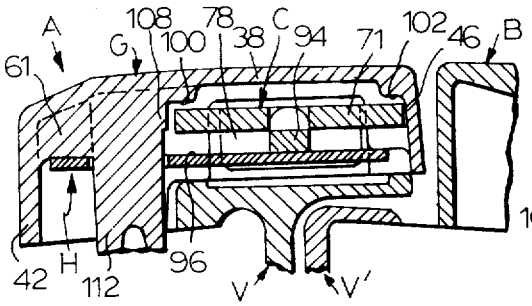
FIG. 2 is a transverse cross-sectional view taken approximately in the plane of line 2—2 of FIG. 1, but with the luggage case walls and valance members omitted.

Push member C is supported for sliding longitudinal movement between an unlatching position (FIG. 6) and a latching position (FIG. 1). Referring to FIGS. 1 and 3, legs 72 and 74 rest upon rib 62 of the frame, with the projecting end of lug 94 of the push member in engagement with the planar top surface portion 96 of the frame. As shown in FIG. 3, the spacing between the bottom edge of rib 50 on the cover and the top of rib 62 on the frame is sufficient to enable sliding movement of leg 74 of the push member therebetween with a slight amount of clearance. Referring to FIGS. 2 and 9, top wall 38 of the cover provides a transversely spaced pair of projecting shoulders 100 and 102 having the same height as rib 50, these shoulders being engageable with the top surfaces of legs 72 and 74, respectively, of the push member to maintain the push member in sliding contact with the frame. With this construction of the cover, the frame, and push member C, the flat end portion 71 of the push member is movable in the plane of that end portion as the push member is moved between the latching and unlatching positions. Tab 78 of the push member extends through opening 57 in side wall 54 of the cover for manual engagement.

As shown in FIG. 6, the cover is constructed to guide the push member for sliding longitudinal movement along a linear path between the latching and unlatching positions. More particularly, side wall 46 of the cover is engageable with the longitudinal edge 104 of push member leg 74. Depending from top wall 38 of the cover for engagement with the opposite longitudinal edge 106 of push member leg 72 are spaced, longitudinally aligned ribs 108 and 110, rib 108 merging with a connecting stud 112 which is described in detail later. Referring to FIGS. 1 and 9, end wall 54 of the cover has inward extensions on both sides of notch 57 to provide a pair of transversely spaced stop surfaces 114 and 116 which are engageable with shoulders 80 and 80', respectively, of push member C for limiting outward movement of the push member from the frame to the unlatching position shown in FIG. 6. Inward movement of the push member is limited by engagement of surface 118 of the push member (FIG. 1) with the one of connecting studs 56 which extends between push member legs 72 and 74.

Figure 7:
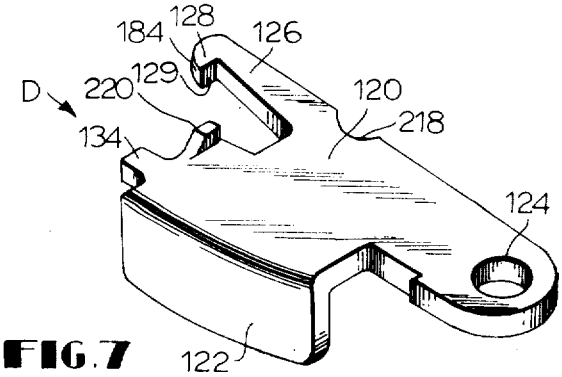
FIG. 7 is a perspective view of the release push bar component of the latching device.

Referring to FIG. 7, the release push member D is formed from a thin steel plate preferably having the same thickness as the plate providing push member C, this plate being formed to provide a pivotable lever comprising a flat plate portion 120 having a manually engageable lug or tab 122 depending perpendicularly from one side thereof. One end of the lever has a circular opening 124 therethrough, while the other end of the lever provides a narrow, longitudinally extending arm 126. A projection 128 extending from the inner side at the end of the arm provides a hook-shaped part of the push member, the projection having a surface 129 which is engageable with shoulder 86 of push member C, as described hereinafter.

Push member D is supported in the latching device housing for pivotal movement between a hold position (FIG. 1) and a release position (FIG. 6) with the flat plate portion 120 thereof being disposed in and movable in the same plane as flat plate portion 71 of push member C. Specifically, opening 124 in the push member D receives a connecting stud 130 (FIG. 5) which projects from top wall 38 of cover G near transverse wall 55, while the flat plate portion 120 of the push member rests upon ribs 62 and 64 of the frame as well as on projection 69 (FIG. 4) of the frame, the height of projection 69 being the same as the height of ribs 62 and 64. Referring to FIG. 6, in addition to rib 50, which overlies arm 126 of push member D, top wall 38 of the cover provides a rib 132 which extends longitudinally from stud 130 to overlie flat plate portion 120 of that push member, both of these ribs acting to maintain the push member in sliding engagement with ribs 62 and 64 and with projection 69 of the frame.

When release push member D is in the normal hold position of FIG. 1, the manually engageable tab 122 thereof is aligned with the cover notch 40 to facilitate manual engagement of the tab. Flat portion 120 of push member D provides a longitudinally projecting lug 134 which is engageable with the thickened inner end region 136 of side wall 42 (FIG. 1) to limit outward pivotal movement of the push member to the hold position. Referring to FIG. 6, lug 134 is further engageable with the outermost end of a short, transverse rib 138 depending from top wall 38 of the cover for limiting inward pivotal movement of the push member to the release position of FIG. 6, the other end of rib 138 merging with the innermost end of rib 110 on the cover. Notch 68 in the frame provides clearance for tab 122 of the push member in the release position.

Biasing means E is provided for urging hasp-engaging push member C outwardly into the unlatching position of FIG. 6 and for urging release push member D outwardly into the hold position of FIG. 1. Preferably, the biasing means comprises music wire of suitable diameter (.030 inch, for example) formed to provide a coiled torsion spring, the central portion of the wire being bent to provide a coil portion 142 (FIGS. 1 and 5), while the opposite end portions of the wire are bent to provide arms 144 and 146 (FIG. 1) which extend outwardly from approximately the mid-portion of coil portion 142. Referring to FIGS. 1 and 5, coil portion 142 of the spring receives a cylindrical stud 148 which projects from top wall 38 of the cover adjacent side wall 42 and extends through an opening 150 in the frame. An outer, annular shoulder 151 is provided at the base of the stud for engaging the top turn of the coiled portion 142 of the spring, while the frame is annularly recessed at 152 to receive the bottom turn of the coiled portion of the spring. Arm 144 of the spring is received in a notch 154 (FIG. 3) in lug 94 on push member C for urging that push member outwardly into the unlatching position of FIG. 6, while the curved end portion 156 of spring arm 146 engages tab 122 of push member D for urging that push member outwardly into the hold position of FIG. 1.

The latching device of the invention may be mounted to wall S of the cooperable luggage case section by any suitable means. For example, in the illustrated latching device connecting studs 112 and 130, which depend from top wall 33 of cover G, extend through corresponding openings 158 in the frame, as shown in FIG. 5, to provide the means for connecting the latching device to the luggage case wall. Where, as illustrated, a valance member V is suitably mounted at the edge of wall S and comprises the female valance member of the case, the latching device may be constructed to overlie and rest upon that valance member. In greater detail, and referring to FIG. 4, valance member V includes a top flange 160 and a bottom flange 162 which project outwardly from web 163 in spaced, parallel relation to provide a recess 164 for receiving the male valance member V' on the other luggage case section when the luggage case is closed. End walls 54 and 55 of the cover member each have a first bottom edge portion 166 for engaging the top surface of wall S and have a second bottom surface portion 168 adjacent thereto and raised relative to portion 166 for engaging the top surface of flange 160 of valance member V, which has a longitudinal groove 170 formed therein. Connecting studs 112 and 130 are extended through openings 172 in wall S and through aligned openings 174 in another bottom flange 176 of valance member V before being headed-over to secure the latching device against wall S and valance member V.

Operation of the latching device will now be described. With the luggage case closed so that projection 30 of the hasp is received between side walls 46 and 48 of the cover and with the latching device in the latching condition shown in FIG. 1, the end of leg 74 of hasp-engaging push member C is received by recess 32 in projection 30 of the hasp so that surface 88' on leg 74 is engaged with hook portion 34 of the hasp to prevent opening of the luggage case sections. Transverse surface 129 of the hook-shaped part of push member D, which is biased outwardly into hold position by spring E, engages transverse surface 86 on leg 72 of push member C to prevent push member C from being moved from latching position to unlatching position under the urging of the spring.

The application of manual force to tab 122 of release push member D (such force being indicated by the arrow in FIG. 6) causes that push member to be pivoted to the release position of FIG. 6 against the force of the spring, thereby moving surface 129 of push member D out of engagement with surface 86 on push member C. This permits the spring, acting through spring arm 144, to snap push member C outwardly into the unlatching position shown in FIG. 6 so that the end of leg 74 is removed from recess 32 of the hasp, thereby enabling the luggage case to be opened. Release of the manual force applied to depress push member D enables the spring, acting through spring arm 146, to return push member D to the hold position of FIG. 1.

With the luggage case closed, the hasp is re-engaged by manually pushing or depressing hasp-engaging push member C inwardly against the force of spring E to move the end of leg 74 into recess 32 of the hasp, the inclined surface 92 at the end of leg 74 being cooperable with the transverse edge 180 (FIGS. 3 and 6) of hasp projection 30 to guide that leg into the recess. During this motion, the inclined surface 88 on leg 72 is brought into sliding contact with the curvilinear surface 184 provided by projection 128 of push member D (which was previously returned to the hold position by the spring), thereby producing a camming action which causes push member D to be pivoted toward the release position against the force of the spring. When push member C reaches the latching position (FIG. 1), surface 88 thereof is moved out of engagement with surface 184 of push member D and the spring snaps push member D outwardly into the hold position. This brings surfaces 86 and 129 of the push members into engagement so that push member C will be maintained in latching position after release of the manual force applied thereto.

By employing push members constructed to have their cooperable parts in the form of flat plate portions which are movable in the same plane, it will be apparent that the latching device of the invention can have thinner construction than the latching devices in which one push member is slidable on the other push member. Also, by mounting the release push member so that it is pivoted about a fixed axis, the friction between the push members is reduced and improved operation is obtained. Moreover, by providing a construction in which a single spring is cooperable with both the hasp-engaging and the release push members, the number of operating parts is reduced, thereby minimizing the cost of manufacture.

Preferably, locking bolt F is provided for releasably locking the latching device in latching condition. Referring to FIG. 6, the bolt member comprises a thin plate of resilient material having a hairpin or U-shaped configuration providing legs 190 and 192. The bolt member may be formed of .051 inch aluminum, for example. The bolt member is supported for sliding longitudinal movement on push member D between a locking position (FIG. 1) and an unlocking position (FIG. 6). The bolt member is guided in this movement by rib 132 on the cover, which engages the outer edge of leg 192, and by a short, longitudinally extending wall or rib 196 and a cylindrical projection 198 which are provided by top wall 38 of the cover and which both engage the outer edge of leg 190, as shown in FIG. 6. The dimensions of the bolt member and the distance between projection 198 and rib 132 of the cover are such that leg 190 of the bolt member is biased into engagement with projection 198, this leg being provided with notches 200 and 202 therein which are cooperable with projection 198 to resiliently maintain the bolt member in the locking and unlocking positions.

Extending laterally from leg 190 of the bolt member are two spaced lugs 204 and 206 which are engageable by a tooth 208 on a key 210 (FIGS. 1 and 3) for moving the bolt member between the locking and unlocking positions. The key is receivable through a keyhole 212 in top wall 38 of the cover (FIGS. 1 and 3) and the frame has an opening 214 therein for receiving the end of the key. As shown in FIG. 6, projection 30 of the hasp is cut away at 216 and push member D is cut away at 218 to provide sufficient clearance to enable rotation of the key, the path of rotation of the projecting end of key tooth 208 being shown in phantom in FIG. 1.

When the bolt member is in locking position (FIG. 1), an upstanding projection 220 on push member D is engageable with surface 222 of the bolt member to prevent movement of that push member to release position, transverse movement of the bolt member by the push member being blocked by rib 196 of the cover. Conversely, when the locking bolt is in the unlocking position (FIG. 6), the surface 222 of the bolt member is moved longitudinally out of blocking relationship with respect to lug 220, thereby permitting push member D to be pivoted inwardly to the release position.

It is believed that the advantages and improved results furnished by the latching device of the invention will be apparent from the foregoing description of a preferred embodiment thereof. Various changes and modifications may be made without departing from the spirit and scope of the invention as sought to be defined in the following claims.

I claim:

1. A latching device cooperable with an associated hasp, comprising first and second push members both having flat plate portions disposed in the same plane and each having an exposed manually engageable tab, the first push member being formed to engage a hasp and being supported for sliding movement in a substantially linear path to latching and unlatching positions with the plate portion thereof being movable in said plane, the second push member being supported for pivotal movement to hold and release positions with the plate portion thereof being movable in said plane, the plate portions of the push members providing cooperable means in said plane for preventing movement of the first push member from latching position when the second push member is in the hold position and for enabling the first push member to be moved to unlatching position when the second push member is pushed into the release position.

2. A latching device according to claim 1, further comprising biasing means for moving the first push member into unlatching position when the second push member is manually moved from the hold position to the release position and for returning the second push member to hold position when the manual force applied thereto is released.

3. A latching device according to claim 1, further comprising a housing including a frame beneath the push members and a cover substantially overlying the push members and connected to the frame, the frame having a planar surface portion parallel to and spaced from said plane and having means projecting upwardly therefrom for supporting the push members with their plate portions in said plane, the cover having guide means for guiding movement of the push members.

4. A latching device according to claim 3, wherein the guide means comprises transversely spaced, longitudinal walls cooperable with opposite edges of the first push member for guiding the first push member and further comprising a stud received by an opening near one end of the second push member for providing the pivotal movement of the second push member between the hold and release positions.

5. A latching device cooperable with an associated hasp, comprising first and second manually operable push members both having flat plate portions disposed in the same plane, the first push member being formed to engage a hasp and being supported for movement to latching and unlatching positions with the plate portion thereof being movable in said plane, the second push member being supported for movement to hold and release positions with the plate portion thereof being movable in said plane, the plate portions of the push members providing cooperable means in said plane for preventing movement of the first push member from latching position when the second push member is in the hold position and for enabling the first push member to be moved to unlatching position when the second push member is pushed into the release position, and a spring having one end cooperable with means provided by the first push member for urging the first push member into the unlatching position and having its other end cooperable with means provided by the second push member for urging the second push member into the hold position.

6. A latching device cooperable with an associated hasp, comprising first and second manually operable push members both having flat plate portions disposed in the same plane, the first push member being formed to engage a hasp and being supported for movement to latching and unlatching positions with the plate portion thereof being movable in said plane, the second push member being supported for movement to hold and release positions with the plate portion thereof being movable in said plane, the plate portions of the push members providing cooperable means in said plane for preventing movement of the first push member from latching position when the second push member is in the hold position and for enabling the first push member to be moved to unlatching position when the second push member is pushed into release position, a housing including a frame beneath the push members and a cover substantially overlying the push members and connected to the frame, the frame having a planar surface portion parallel to and spaced from said plane and having means projecting upwardly therefrom for supporting the push members with their plate portions in said plane, the cover having guide means for guiding movement of the push members, and a spring located between said planar surface and said plane, one end of the spring urging the first push member outwardly from the housing toward unlatching position an the other end of the spring urging the second push member outwardly from the housing toward the hold position, the spring moving the first push member from latching to unlatching position when the second push member is moved from hold to release position.

7. A latching device according to claim 6, wherein the spring comprises a torsion spring having a coiled central portion receiving a projection on the cover.

8. A latching device according to claim 6, wherein each of the push members has a manually engageable tab perpendicular to the plate portion thereof, wherein the first push member has a lug depending from the plate portion thereof and engaging the planar surface of the frame, and wherein said one end of the spring engages the lug on the first push member and the other end of the spring engages the tab of the second push member.

9. A latching device cooperable with an associated hasp, comprising first and second manually operable push members both having flat plate portions disposed in the same plane, the first push member being formed to engage a hasp and being supported for movement to latching and unlatching positions with the plate portion thereof being movable in said plane, the second push member being supported for movement to hold and release positions with the plate portion thereof being movable in said plane, the plate portions of the push members providing cooperable means in said plane for preventing movement of the first push member from latching position when the second push member is in the hold position and for enabling the first push member to be moved to unlatching position when the second push member is pushed into the release position, a housing including a frame beneath the push members and a cover substantially overlying the push members and connected to the frame, the frame having a planar surface portion parallel to and spaced from said plane and having means projecting upwardly therefrom for supporting the push members with their plate portions in said plane, the cover having guide means for guiding movement of the push members, and a key-actuatable bolt member slidably supported on the second push member, the cover providing additional guide means for guiding the bolt member for sliding movement between locking and unlocking positions, the second push member having a projection upstanding from the plate portion thereof, the projection being cooperable with the bolt member for blocking movement of the second push member from the hold position when the bolt member is in locking position and for permitting the second push member to be pushed from the hold position to the release position when the locking member is in the unlocking position.

10. A latching device cooperable with an associated hasp, comprising first and second manually operable push members both having flat plate portions disposed in the same plane, the first push member being formed to engage a hasp and being supported for movement to latching and unlatching positions with the plate portion thereof being movable in said plane, the second push member being supported for movement to hold and release positions with the plate portion thereof being movable in said plane, the plate portions of the push members providing cooperable means in said plane for preventing movement of the first push member from latching position when the second push member is in the hold position and for enabling the first push member to be moved to unlatching position when the second push member is pushed into the release position, a housing including a frame beneath the push members and a cover substantially overlying the push members and connected to the frame, the frame having a planar surface portion parallel to and spaced from said plane and having means projecting upwardly therefrom for supporting the push members with their plate portions in said plane, the cover having guide means for guiding movement of the push members, the plate portion of the first push member being generally U-shaped and having a pair of substantially parallel legs, the first push member being supported for sliding movement in a linear path substantially parallel to said legs, one of the legs being engageable with the hasp, and the cooperable means comprising a hook-shaped part of the other leg of the first push member and a hook-shaped part of the plate portion of the second push member.

* * * * *